United States Patent [19]

Dandine

[11] 4,060,067

[45] Nov. 29, 1977

[54] TRIGGER ASSEMBLY FOR SPRING LOADED WEAPONS

[76] Inventor: Pierre Dandine, 23 Boulevard Franck Pilatte 06300, Nice, France

[21] Appl. No.: 633,785

[22] Filed: Nov. 20, 1975

[30] Foreign Application Priority Data

Nov. 21, 1974 Monaco ..... 1130

[51] Int. Cl.[2] ..... F41B 7/04

[52] U.S. Cl. ..... 124/31; 124/22

[58] Field of Search ..... 124/17, 21, 22, 35, 124/41, 27, 25, 41 A, 41 R, 31

[56] References Cited

U.S. PATENT DOCUMENTS

| | | | |
|---|---|---|---|
| 2,627,260 | 2/1953 | Zimmerman | 124/27 |
| 3,850,157 | 11/1974 | Prokupek | 124/27 |

FOREIGN PATENT DOCUMENTS

| | | | |
|---|---|---|---|
| 960,272 | 10/1949 | France | 124/27 |

*Primary Examiner*—Richard C. Pinkham
*Assistant Examiner*—William R. Browne

[57] ABSTRACT

A trigger assembly for launching the projectile of a spring loaded weapon such as a harpoon, cross-bow or the like is disclosed having a detent adapted to engage the rear end of the projectile. The detent swingable about an axle fixed to the butt stock and a spring member is supported within the butt stock to engage said detent. The forces created by the projectile acting on the detent, cause said spring member to curve into a reactive position, the curvature of the spring in the reactive position is limited and a trigger member is provided for displacing the spring from its curved position into a position releasing the reactive force on said detent.

10 Claims, 1 Drawing Figure

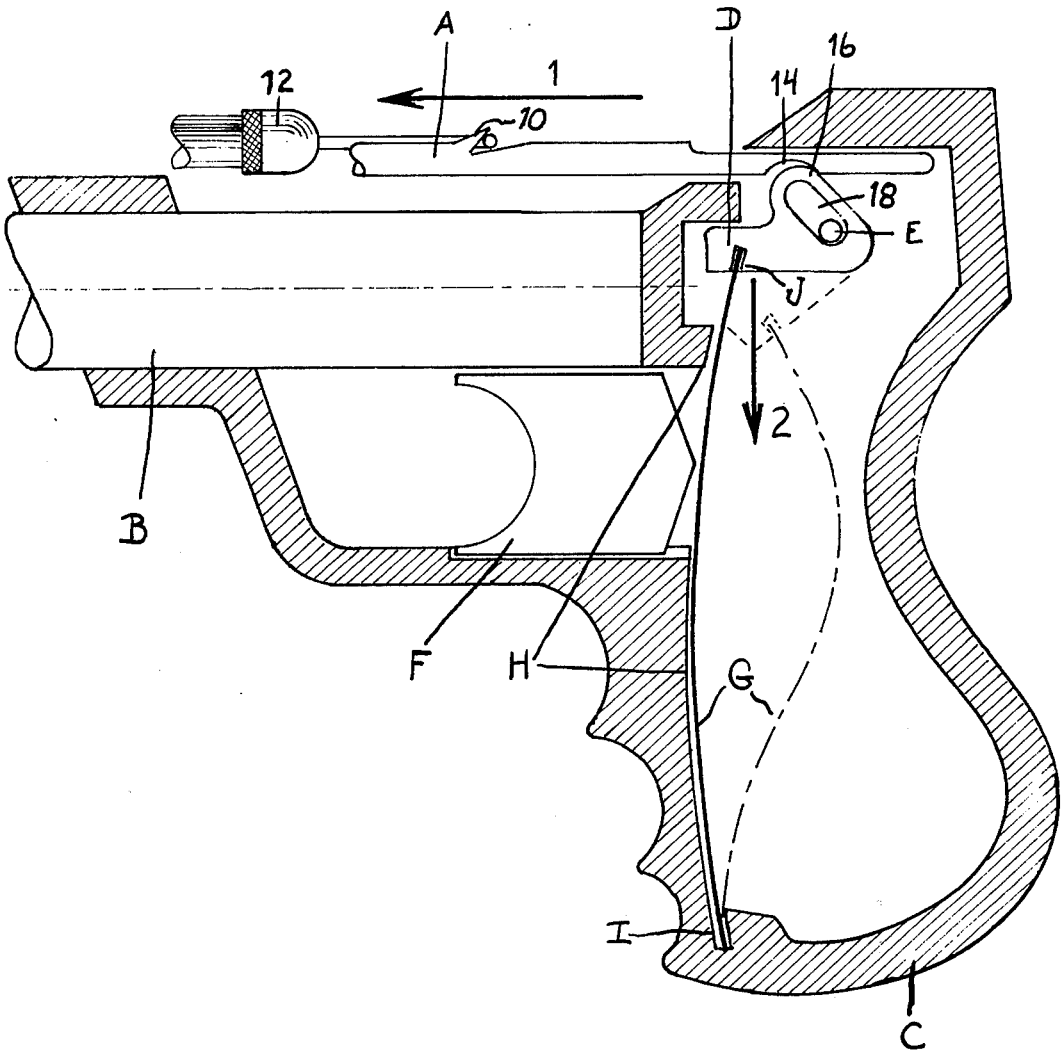
A
D
16
12
1
14
10
18
E
J
2
B
F
H
G
I
C

TRIGGER ASSEMBLY FOR SPRING LOADED WEAPONS

BACKGROUND OF THE INVENTION

The present invention relates to apparatus for triggering hand held spring loaded weapons, such as a target gun, marine harpoon, cross-bow, javelin or the like and in particular to the provision of an improved detent mechanism for loading and for triggering of such weapons.

In devices of this type, the projectile, such as a harpoon arrow or the like, is propelled by an elastic spring or similar compression member. The projectile itself is provided with a notch which is engaged by the spring, which when jointly pulled places the spring under tension, (or compression, as the type of spring may dictate). The mechanism includes a trigger assembly which is adapted to hold the arrow and spring in the stressed position and which will allow for the release of the same when desired. In the known devices, this assembly includes a trigger piece pivotable about an axle and biased by a plurality of springs against a catch or the like. The pivot trigger piece engages along one extremity thereof a second notch formed on the projectile and being biased by the springs, thus holds the projectile in its stressed position. Another extremity of the trigger piece abuts against the catch which holds the trigger in place until actuated by the shooter.

When the shooter wishes the arrow to be let go he compresses the trigger which pivots under the stress of the projectile, permitting the launching of the projectile.

Devices of this type, have a great many disadvantages and inconveniences. The principle disadvantage lies in the fact that the frictional forces exerted on the contract surfaces of the assembly, are extremely high. Thus, in order for the shooter to overcome the frictional inertia, it is necessary for him to develop an equally high force on the trigger assembly. In addition, the frictional forces occurring cause a rapid wear of those contacting surfaces and particularly of the release surfaces between the trigger piece and the projectile, the trigger piece and the detent, resulting in the early deterioration in the point of launching, and thus imprecise aiming and trajectory of the projectile.

A further inconvenience of the known devices, lies in the fact that the trigger assembly is constituted by an unnecessarily large number of members, requiring plural pivot axles and plural springs.

It is the object of the present invention to provide a trigger assembly which overcomes the disadvantages and inconveniences of the prior art.

It is a further object of the present invention to provide a trigger assembly of simple design, having dew components and which eliminate the frictional forces upon the projectile and the trigger.

The foregoing objects, as well as other advantages of the present invention are set forth in the following specification.

SUMMARY OF THE INVENTION

According to the present invention, a trigger assembly is provided comprising a detent, engagable with the projectable, a trigger manipulatable by the shooter, and a flexible spring member or lamella, normally biased by reaction with the detent on loading of the projectile to hold the detent in engagement with the projectile, and which is bucklable out of this normal biased position to release the detent.

Preferably the spring member is an elongated flat leaf spring one end of which is supported in a bed such as a groove or notch, provided in the interior portion of the butt stock of the weapon. The upper end of the lamella is applied directly or indirectly across an intermediate piece against the detent. At a position intermediate the spring a manually operable trigger is located which can be used to cuase the spring to reverse its biased position. By this kind of interconnection, one component of the forces transmitted by the stressed projectile, acting against the detent itself, provides for bending of the spring into a fixed normal position. The bending or buckling of the spring in this fixed normal condition is limited by forming the interior of the butt stock with a cradle. To ensure the normal bending will always occur in this position, the spring may be slightly preformed or may be provided with such length that as it seats at each of its ends in the butt stock and the detent it is precurved and maintains a slight over-the-center biasing. In this position the spring member exerts normally compressive on the detent which prevents the liberation of the projectile. Should the user desire to release the projectile, he exerts directly or indirectly, by the use of the trigger finger a force on the central portion of the spring causing a rapid change in its normal curvature causing the spring to buckle in the opposite direction beyond its over-the-center position. The buckling of the spring causes the spring to collapse along its axial length releasing the compression on the trigger piece and allowing the stress projectile to be released. In using a flexible elongated flat spring, the over-the-center axis can be defined by an axial line through the ends of the curved spring.

The buckled spring obtains such a curvature in its collapsed condition that it freely relinquishes the detent and frees the projectile. When the projectile has departed, the shooter releases the trigger which is free to return to its initial position, and which is urged into that initial position, by the return of the flexible spring to its normal curved position.

When the weapon is reloaded by introduction of the projectile, the rear end will engage the detent and the detent will again become lodged in the retaining notch. It is possible to provide a trigger assembly in which the relative position of projectile pivot of the detent, and its supporting point, are different from those indicated above. The elements may be inverted so that the projectile may be placed below the detent as may be desired in certain weapons, wherein the projectile is loaded through a central barrel. It is also possible to insert directly into the notch on the projectile, the upper end of the flexible elongated spring, (i.e. avoid the use of a pivotal detent) the lower end of the spring means in this case is set within a slot or groove footing as indicated above and supported by any means assuring its return into a fixed preset curvature or over-the-center position abutting against the cradle, formed in the stock, maintaining the harpoon in its loaded position until buckled. If desired, the trigger may be removed and the shooter permitted to exert the force directly onto the flexible member without having to operate a finger piece.

It is also possible to regulate or adjust the depth of the cradle to provide any desired precurvature of the elongated spring means so as to insure its preformed curvature, and the degree of force needed to cause its buckling. A helicoidal spring may be used in place of the flat spring.

Full details of the present invention are set forth in the following disclosure, and are shown in the accompanying drawing.

BRIEF DESCRIPTION OF THE DRAWING

In the drawing FIGURE is an elevational cross-sectional view of the handle or butt end of a weapon taken along the vertical center line of the weapon.

DESCRIPTION OF THE INVENTION

In the drawing, only the butt end of the weapon is shown, the elongated bore or barrel is partially omitted. Furthermore, the illustrated embodiment illustrates an under-water or submarine harpoon weapon of otherwise conventional nature.

In the drawing, a projectile A, such as a harpoon is shown, having a forward notch 10 in which is engaged a propulsion member such as a string spring 12 which is fastened at its outer ends to the forward end of the weapon or to a cross-member (similar to a cross-bow construction). The projectile is provided with a second notch 14 at its reward or nock end. The weapon is provided with an elongated tubular barrel B at the butt end of which is provided a hollow butt stock C shaped in the form of a hand grip. Mounted at the upper end of the hand stock C is a detent D generally triangular in form having a boss 16 at its upper end which is adapted to engage within the retaining notch 14 on the projectile. The detent D is provided with an elongated slot 18 set at an angle to the central axis of the barrel B (and thus the axis of the projectile) in which is located a transverse fixed axle pin E about which the detent D may swing, i.e. pivot and slide axially. Mounted beneath the barrwl B is a trigger member F which is freely slidable in a groove-way or key as desired, into and out of the butt stock. Further mounted within the butt stock is an elongated flexible lamella G of the leaf-spring type which is provided as hereinafter described with a preset curvature, convexedly outward toward the trigger member F. The leaf spring G is normally biased to sit within a concave cradle, formed by shaping the interior wall of the butt stock C adjacent to trigger F and the barrel B as well as the finger portion of the butt stock. The elongated leaf spring is seated at its seated at its lower end in a grooved or slotted footing I and at its upper end in a similar grooved or slotted footing J. The lower end of the spring may be fixed to the butt stock, but it is preferable that at least the upper end be freely held in the detent or against the detent to permit relative movement. In the reactive position, that is when the weapon is loaded, the clockwise rotation of the detent is limited be engagement with a projecting cam surface of the butt end of the barrel B, as shown.

In loading the projectile A onto the weapon, the propulsion spring 12 is set within the notch 10 and the projectile forced rearwardly into the weapon, in the direction opposite to the force vector indicated by the numeral 1 (i.e. to the right in the figure) whereupon the nock end of the projectile engages the boss 16 of the detent D tending to force the detent D downwardly in the direction of the force vector indicated by the arrow 2. The downward movement of the detent D is permitted by the slot 18 sliding over the axle E. This obtains until the boss 16 enters into the notch 14. As a result of which the propulsion spring 12 tends to move the projectile along the force vector 1 resulting in a tendency to pivot the detend D counter clockwise about the axle E causing the force along the force vector 2. Because of the prestress or precurvature of the elongated spring G the resultant force vector 2 tends to increase the convex curvature of the spring causing it to firmly seat against the cradle H. In this condition the fixing of the lower end of the elongated spring H in the footing I a counter reaction force (counter to vector force 2) is created, balancing the counter clockwise force on the detent. Because of the footings I and J and the cradle H the elongated spring is held in this balanced state, maintaining the detent in fixed and firm engagement with the projectile so as to hold the projectile in a fixed stationary position. A force sufficient only to counter flex the spring over its center position is all that is necessary to release the detent and the projectile.

The apparatus operates in the following manner:

When the shooter desires to release the projectile, he compresses the trigger F forcing the inner end of the trigger F, which is conceniently provided with a crowned surface, against the central portion, or convex side of the elongated spring G. This causes the spring G to cross over the central axis determined by its extremedies, i.e. footing I situating near the bottom of the butt stock C, and the upper footing J, in which it is in contact with the detent D. Under these conditions the flexible spring, once extending over its central poistion, instantly deforms and buckles onto the opposite side of the butt stock C as indicated in the dot-dash line of the drawing. The buckling occurs instantaneously upon reaching the-over-center position, and causes the effective length of the elongated spring, between the bottom of the butt stock C and the detent D to contract and become smaller, thus freeing the detent D from any counter reaction to the force vector 2. Thus, the stressed projectile A causes an interaction between the surface of the notch 14 and the boss 16 swinging the detent D about axle E and instantaneously releasing the projectile.

After the projectile has departed from the weapon and there is no longer any force vector 2 upon the detent D, the resilient nature of the flexible elongated spring G causes it to return to its elongated position i.e. its normal biased position by its reaction at its lower end in the footing I of the butt stock. The detent D being freely pivotable about the axle E permits the elongated spring to return to its preformed convex curvature as shown in the solid lines. On recharging the weapon the butt extremity of the projectile A pushes against the boss 16 of the detent D which slides downwardly along slot 18 until the boss 16 engages within the notch 14. At this point the force vector 2 and its counter force on the detent D are in balance and the projectile is held in fixed position. The projectile A in this condition again supplies the initial force which holds the elongated spring G in its convex preformed condition until triggered by the shooter pressing the trigger F.

As will be seen from the foregoing, the present invention provides a simple triggering assembly comprising a single detent, a single pivot axle and a single elongated flat spring. The present invention avoids or suppresses frictional engagement between the members, and particularly avoids frictional engagement during the triggering operation between the projectile A and the detent since once the spring G collapses, the detent falls out of engagement with the projectile. The flexible spring is supported at its lower end in the butt stock and receives at its upper end the forces resulting directly from the loaded projectile. The curvature initiated by its loading, on the elongated spring G is limited by the shape of the cradle, which shape may be adjusted and designed as desired, to regulate more or less the force on the spring G and the force needed to overcome its biassed position, i.e., the force needed to move the spring beyond its central axis position. If it is desired, the elongated flat spring G shown as the preferred embodiment, may be replaced by a helicoidal spring which would serve the same purpose. It will be also appreciated that the trigger F can be removed and the spring G actuated, by direct manual depression.

It may also be preferred that the elongated spring G be preformed with a slight convex curvature so as to ensure its return to its normal biasing position. Furthermore, its length should be chosen with regard to the length of the butt stock so that it is maintained in this convex curvature under normal conditions, and that its length and resiliency are such that it will resume its normal biasing position, immediately upon the release of projectile from the weapon.

It will also be appreciated that while in the prefered embodiment the projectile A is shown as being placed above the detent, the same elements may be inverted, and the projectile loaded, for example, through the varrel of the weapon, or as an alternative the elongated spring G would be placed in direct contact with the projectile itself. The convex curvature of the spring, permitting in the latter instance, the loading of the weapon and the placement of its upper end into the notch 14.

While the prefered form of the detent is indicated here as triangular, the detent may be an elongated rectangular member, provided with a boss at its upper edge, and the slot in which the axle pin fits, may have a shallower angle, than shown in the figure so that the swinging movement of the detent is less pronounced. In addition, the trigger, rather than being a simple slidable member can be more in the form of a pivotal latch member, or a cammed latch member cooperating with the interior of the weapon to engage the elongated spring.

The present invention is applied to all type of hand held spring loaded weapons and guns of the described type although it is primarily intended for submarine harpoon of the cross-bow type, known an arbalests. Several modifications and changes have been suggested other changes modifications and embodiments will be apparent to those skilled in the present art. It is therefore intended that the present disclosure be taken as illustrative and not as limiting of the invention.

What is claimed is:

1. A trigger assembly for launching the projectile of a spring loaded weapon comprising a barrel hollow butt stock in which the rear end of the projectile is received, an axle fixedly mounted in said butt stock transversely to the direction of the barrel, a detent adapted to engage the rear end of the projectile, said detent being mounted within said butt stock and swingable about said axle, said detent having a slot through which said axle passes, said slot extending at an angle to the axis of said barrel so as to be axially movable and pivotable about the axle, a spring means supported within said butt stock, said spring means including a spring, said spring directly engaging said detent, and said spring means being in stressed condition when the gun is in a cocked condition to produce a force on said detent to hold a projectile in a retracted position, means located within said butt stock for limiting the flexing of said spring means when a projectile is in a cocked condition, and a trigger member for displacing said spring means from its flexed position when the gun is in a cocked position to a position releasing the spring means force on said detent.

2. The assembly according to claim 1 wherein said detent is provided with boss adapted to engage within a notch normally formed on a projectile.

3. The assembly according to claim 1 wherein said said means located within said butt stock comprises a cradle adapted to receive said spring means in said stressed condition.

4. The assembly according to claim 1 wherein said spring means is an elongated flat spring.

5. The assembly according to claim 1 wherein said spring means is a helicoidal spring.

6. The assembly according to claim 4 wherein the lower end of said elongated spring is fixed at its lower end to said butt stock.

7. The assembly according to claim 4 wherein said elongated spring is seated within slots formed at the lower end in said butt stock and at the upper end in said detent.

8. The assembly according to claim 1 wherein said elongated spring is curved having an axis extending between its two ends, and which is bucklable by flexing across said axis.

9. The assembly according to claim 1 wherein the detent has a generally triangular shape of the barrel of the weapon so as to be axially movable and pivotable about the axle.

10. The assembly according to claim 1 wherein said spring means is inherently resilient and returnable to its initial present bias.

* * * * *